US011744346B2

(12) United States Patent
Schreiber

(10) Patent No.: US 11,744,346 B2
(45) Date of Patent: Sep. 5, 2023

(54) COSMETIC PRODUCT APPLICATION DEVICE, RELATED KIT AND RESERVOIR

(71) Applicant: L'OREAL, Paris (FR)

(72) Inventor: Camille Schreiber, Clichy (FR)

(73) Assignee: L'OREAL, Paris (FR)

( * ) Notice: Subject to any disclaimer, the term of this patent is extended or adjusted under 35 U.S.C. 154(b) by 617 days.

(21) Appl. No.: 16/478,054

(22) PCT Filed: Jan. 11, 2018

(86) PCT No.: PCT/EP2018/050616
§ 371 (c)(1),
(2) Date: Jul. 15, 2019

(87) PCT Pub. No.: WO2018/130597
PCT Pub. Date: Jul. 19, 2018

(65) Prior Publication Data

US 2019/0357660 A1 Nov. 28, 2019

(30) Foreign Application Priority Data

Jan. 16, 2017 (FR) ..... 17 50323

(51) Int. Cl.
*A45D 40/26* (2006.01)
*A46B 9/02* (2006.01)

(52) U.S. Cl.
CPC ..... *A45D 40/267* (2013.01); *A45D 40/264* (2013.01); *A46B 9/021* (2013.01); *A45D 2200/25* (2013.01)

(58) Field of Classification Search
CPC .... A46B 9/021; A45D 40/264; A45D 40/265; A45D 34/045; A45D 34/043
See application file for complete search history.

(56) References Cited

U.S. PATENT DOCUMENTS 1,607,702 A * 11/1926 Siline ..... B27G 11/02 401/15
2,509,369 A * 5/1950 Roberson ..... B65D 47/42 401/122

(Continued)

FOREIGN PATENT DOCUMENTS

CN 1144464 A 3/1997
CN 200962950 Y 10/2007

(Continued)

*Primary Examiner* — Nicholas D Lucchesi
*Assistant Examiner* — Jennifer Gill
(74) *Attorney, Agent, or Firm* — POLSINELLI PC

(57) ABSTRACT

Cosmetic product application device, related kit and reservoir The device (14) includes: —an applicator (40), comprising a gripping member (44) and a product application member t (46) intended to plunge into a reservoir (12) of a cosmetic product; —an intermediate part (42) comprising a attachment sleeve (70) for the removable fastening of the gripping member (44), with the attachment sleeve (70) defining a circulation hole (76) of the product application member (46). The intermediate part (42) comprises an outer band (72) for protecting the applicator (40) protruding opposite the attachment sleeve (70), the band (72) having at its free edge (88) an insertion opening (90) of the reservoir (12). The intermediate part (42) comprises an inner fastening member (74) for the removable fastening of the reservoir (12), protruding in the band (72) opposite the attachment sleeve (70).

17 Claims, 2 Drawing Sheets

(56) References Cited

U.S. PATENT DOCUMENTS 4,705,053 A * 11/1987 Goncalves ..... A45D 40/268 401/122
6,076,531 A * 6/2000 Gueret ..... A45D 40/267 132/218
6,089,774 A 7/2000 Franken et al.
6,309,124 B1 * 10/2001 Gueret ..... B65D 51/24 401/125
6,539,950 B1 * 4/2003 Gueret ..... A45D 40/267 132/218
7,066,675 B1 * 6/2006 Miller ..... A45D 29/007 401/126
7,481,592 B2 * 1/2009 Gueret ..... A45D 40/26 401/122
2001/0033766 A1 * 10/2001 Gueret ..... A61N 2/002 401/130
2005/0232681 A1 * 10/2005 Gueret ..... A45D 34/04 401/122
2005/0249539 A1 * 11/2005 Habatjou ..... A46B 9/021 401/127
2008/0060669 A1 * 3/2008 Malvar ..... A46B 3/18 132/218
2010/0310297 A1 * 12/2010 Gueret ..... A01N 59/16 401/129
2011/0176856 A1 * 7/2011 Gardner ..... A45D 40/265 401/195
2012/0148332 A1 * 6/2012 Stredak ..... A45D 40/267 401/122
2017/0245618 A1 * 8/2017 Chen ..... A45D 34/043

FOREIGN PATENT DOCUMENTS

| | | | | |
|---|---|---|---|---|
| CN | 103565083 | A | | 2/2014 |
| CN | 106061862 | A | | 10/2016 |
| FR | 2 107 101 | A5 | | 5/1972 |
| GB | 1 313 244 | A | | 4/1973 |
| JP | H09 117322 | A | | 5/1997 |
| KR | 20110006269 | U | | 6/2011 |
| KR | 200472950 | | * | 5/2014 |
| WO | WO 01/78551 | A1 | | 10/2001 |

* cited by examiner

COSMETIC PRODUCT APPLICATION DEVICE, RELATED KIT AND RESERVOIR

CROSS REFERENCE TO RELATED APPLICATIONS

This application is a National Phase filing under 35 U.S.C. § 371 of PCT/EP2018/050616 filed on Jan. 11, 2018; which application in turn claims priority to Application No. 17 50323 filed in France on Jan. 16, 2017. The entire contents of each application are hereby incorporated by reference.

This invention relates to a cosmetic product application device, comprising:

- an applicator, comprising a gripping member and a product application member intended to plunge into a reservoir of a cosmetic product;
- an intermediate part comprising an attachment sleeve for the removable fastening of the gripping member, the attachment sleeve defining a circulation hole of the product application member;

Such a device is intended to be mounted on a reservoir containing a cosmetic product, in particular a cosmetic product for makeup, coloration or care, in particular a mascara.

A cosmetic product is more generally a product as defined in EC Regulation N° 1223/2009 of the European Parliament and the Council of Nov. 30, 2009, relating to cosmetic products.

Packaging devices for mascara generally comprise a reservoir of a cosmetic product that has a threaded neck on the upper end thereof. An applicator comprising a brush plunging into the reservoir and a gripping member is screwed onto the attachment sleeve and can be unscrewed in order to allow the user to apply mascara on keratinous fibers.

These devices are not fully satisfactory. They must in general be entirely discarded once the mascara has been used. Moreover, when the reservoir has a rigid wall, it is difficult to recover all of the mascara present inside the reservoir using the brush.

In order to overcome this problem, JP9117322 describes a packaging device of the aforementioned type comprising a reservoir that comprises a flexible pocket integral with the attachment sleeve, and an outer rigid shell, into which the flexible pocket is inserted. The outer shell has windows. Flexible intermediate members are inserted into the windows in order to allow the user to press the pocket, facilitating a more complete extraction of the mascara.

Such a device can be further improved. Indeed, as the outer shell is fastened onto the attachment sleeve, the device has to be discarded after use.

Furthermore, the brush is able to be crushed by the user when the reservoir is pressed, which can lead to a deterioration of the device.

US20120014738 describes a device in which the restitution of the product is not optimal, since the reservoir cannot be deformed. EP1411797 and EP 2308339 describe packaging devices that have a flexible pocket and a rigid shell covering the flexible pocket.

An object of the invention is to obtain a device for application of a cosmetic product that limits the environmental impact, while still being reliable to use.

To this effect, the invention has for object a device of the aforementioned type, characterized in that the intermediate part comprises an outer band for protecting the applicator protruding opposite the attachment sleeve, with the band having at its free end an insertion opening of the reservoir, with the intermediate part comprising an inner fastening member for the removable fastening of the reservoir, protruding in the band opposite the attachment sleeve, with the inner fastening member for fastening comprising at least one axial locking abutment of the reservoir in the band.

The presence of a protective band, open at its free end, and directly associated with a member for the removable fastening of the reservoir in the band, allows for an optimum restitution of product, by limiting the risk of deterioration of the applicator arranged in the reservoir. Furthermore, the possibility of using a reservoir removably mounted in the band prevents having to discard the entire device, also limiting the environmental impact.

The protective band also makes it possible to propose a personalized casing. The protective band can as such be carried out in more elaborate materials. Furthermore, as the protective band is not in direct contact with the cosmetic product, the materials that can potentially be used are greatly increased. This can in particular be recycled plastic.

According to an advantageous aspect, the attachment sleeve and the band are formed from a single piece. The forming of the attachment sleeve and of the band from a single piece simplifies manufacturing, limits the cost and improves the robustness of the device According to another advantageous aspects:

- the inner fastening member comprises a peripheral skirt, with the locking abutment radially protruding from the peripheral skirt;
- the locking abutment is a threading or a snap-locking member.

The presence of an abutment radially protruding with respect to a skirt simplifies the mounting of the reservoir in the device and guarantees a good seal and suitable robustness.

According to advantageous aspects:

- when the applicator is mounted on the attachment sleeve, the band extends opposite the attachment sleeve along an axis of insertion of the reservoir in the band, at least to a projection of the free end of the product application member on the axis of insertion.
- when the applicator is mounted on the attachment sleeve, the band exceeds the projection of the free end of the product application member on the axis of insertion at most 10.5 mm, a reservoir mounted on the inner removable fastening member for the being advantageously intended to protrude outside of the band through the insertion opening.

A suitable length of the band with respect to the application member ensures good protection of the applicator, in particular when the reservoir has been removed, or with the use of a flexible reservoir.

According to advantageous aspects, the attachment sleeve has a threading, with the gripping member having a complementary threading complementary with the attachment sleeve able to engage on the threading of the attachment sleeve.

Advantageously, the product application member comprises a rod and an applicator element, in particular a brush or a comb, mounted at the end of the rod.

The application device according to the invention is particularly adapted for applicators comprising a rod and a brush or a comb, with the applicator preferably able to be screwed onto the attachment sleeve for simple use.

A comb is an applicator element comprising several separation/combing elements protruding from a central axis over an angular extent greater than 180°, advantageously over an angular extent equal to 360°.

A brush is an applicator element comprising several separation/combing elements protruding from a central axis over an angular extent greater than or equal to 180°, in particular less than 100° about the central axis.

Two major types of application members are generally distinguished, namely so-called "fiber" application members and so-called application "molded" members.

Fiber application members are conventionally formed by winding as a helix, or twisting, of two branches of a metal wire forming a core around bundles of bristles extending radially from the metal wire.

The two metal branches can be two separate strands or be obtained using the same metal wire folded back on itself.

Such application members are also referred to as having a twisted core.

Molded application members are obtained at least partially by molding of at least one thermoplastic material.

In particular, the thermoplastic material is an elastomer thermoplastic material.

The term elastomer thermoplastic material generally means the polymers or mixture of polymers that have, at the service temperature, properties similar to those of vulcanized rubber. These properties disappear at the implementation temperature, making possible a later implementation, but reappear when the material returns to the service temperature (cf. standard ISO 18064:2014). For general information on elastomer thermoplastic materials, reference can be made in particular to the guide Techniques de l'Ingénieur, Traité Plastiques et Composites, AM 3 400 by Michel Biron published on 10 Jul. 2000.

The thermoplastic material used can be, for example, SEBS (Styrene-Ethylene/Butylene-Styrene), a silicone, butyl, EPDM (Ethylene Propylene Diene Monomer), a nitrile, a thermoplastic elastomer (TPE), a polyamide, polyethylene or vinyl polyester, but also a polyolefin such as polyethylene (PE) or polypropylene (PP), PVC, PS, PET, POM, PA or PMMA.

The materials known commercially under the brands Hytrel®, Cariflex®, Alixine®, Santoprène®, Pebax® can in particular be used, although this list is not exhaustive.

Moreover, although preferably intended for an organ for applying a makeup product such as a mascara, this invention also relates to applicators of care products made from specific materials that are generally more expensive.

As such, the product application member can include a ceramic material, a metal such as aluminum or zamac, able in particular to procure a refreshing effect upon application According to an advantageous aspect, the band is at least partially perforated. The presence of a partially perforated band improves the aesthetic aspect of the device. Such a band makes it possible in particular to observe the level of the product when the tube is transparent and/or to determine the condition of the tube.

The invention also has for object a kit of the aforementioned type, comprising:

- a device as described hereinabove;
- a reservoir of a cosmetic product, removably mounted on the inner fastening member in the band.

According to another advantageous aspects:

- the reservoir protrudes outside of the band through the insertion opening;
- the reservoir comprises an internal portion inserted into the band and a portion protruding outside of the band, an outer surface of the band being flush, an outer surface of the portion protruding outside of the band;
- the reservoir comprises a wall with a stretchability greater than the stretchability of the band.

The arrangement of at least one portion of the reservoir protruding with respect to the band offers a satisfactory aesthetic aspect, and makes it possible, when the reservoir is formed from at least one deformable wall, to have a very effective restitution of the product.

According to an advantageous aspect, the kit comprises a wiping member mounted on the reservoir and/or on the inner fastening member.

The presence of a wiping member on the reservoir and/or on the inner fastening member provides a controlled distribution of the product.

According to an advantageous aspect, the kit comprises an auxiliary cosmetic product reservoir able to be mounted on the inner fastening member in the band in place of the reservoir.

Using an auxiliary reservoir as a replacement for a reservoir reduces the environmental aspect by preventing having to discard the entire kit and offers improved personalization of the kit.

Moreover, it is also possible to propose a kit that as such comprises a first reservoir that comprises a makeup product for the day, and a second reservoir containing a makeup product for the evening or night. The unused reservoir will preferably by closed by its cap.

According to an advantageous aspect, the reservoir comprises a neck able to cooperate with the inner fastening member, the neck comprising a complementary locking abutment or a complementary locking housing cooperating with the axial locking abutment of the reservoir in the band. These features provide a robust and sealed fastening of the reservoir in the band.

The invention also has for object a reservoir, intended to be mounted in an application device such as defined hereinabove, with the reservoir advantageously comprising:

- a deformable wall defining an inner volume containing a cosmetic product, the wall comprising a neck able to cooperate with the inner fastening member; and
- a removable cap mounted on the neck.

The invention will be easier to understand after reading the following description, provided solely as an example and with reference to the appended drawings, wherein.

Figure 1:
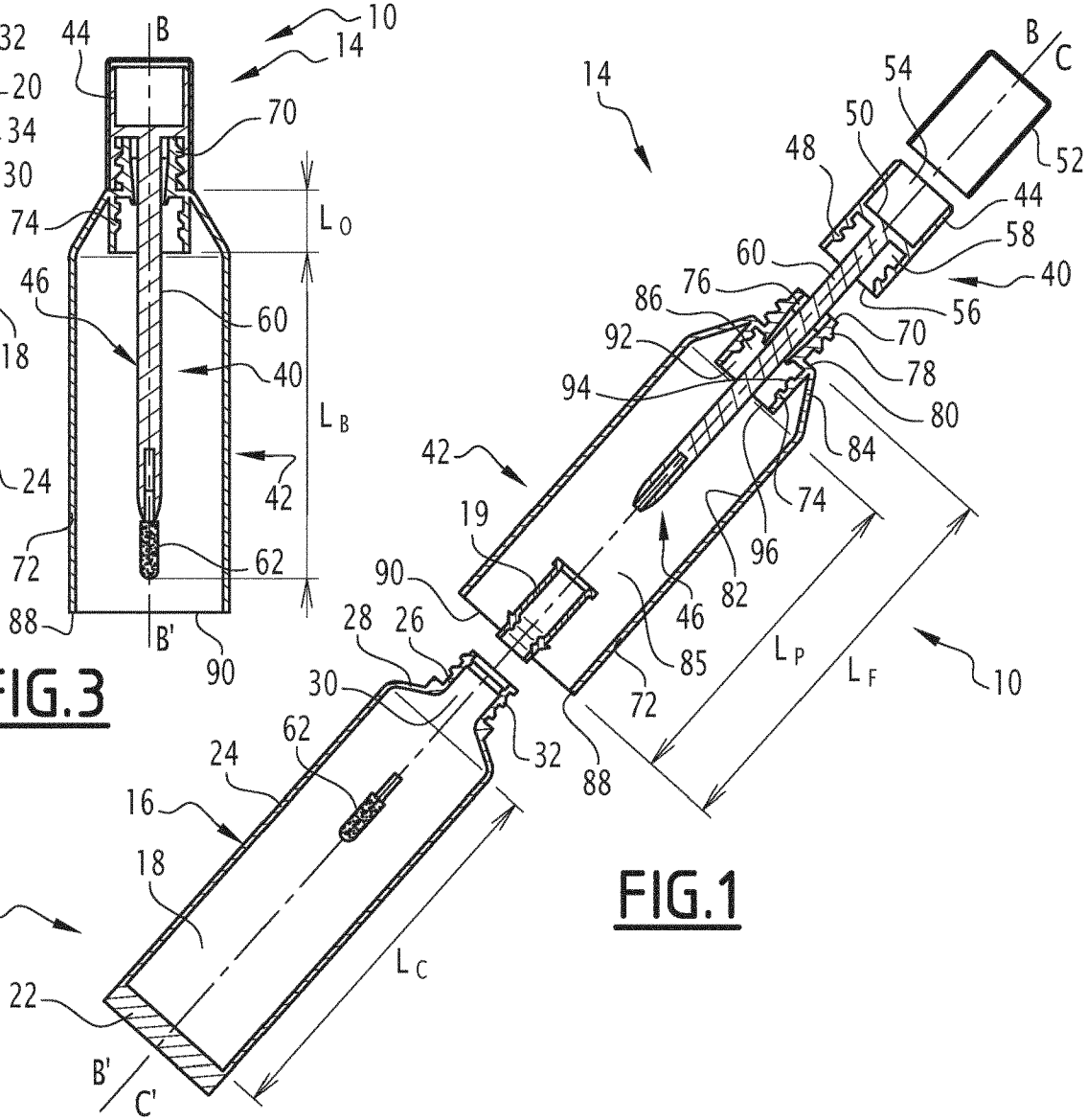
FIG. 1 is an exploded view, taken as a cross-section along a medial axial plane, of a first kit for cosmetic product packaging and application according to the invention.
Figure 3:
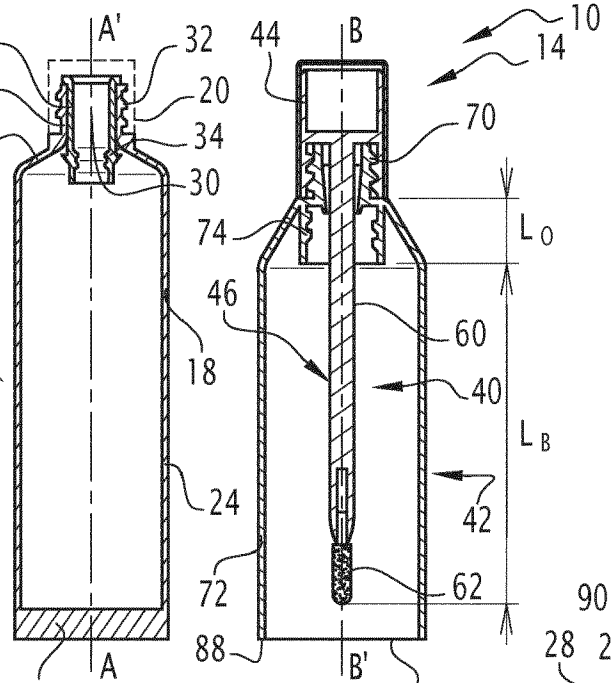
FIG. 3 is a cross-section view similar to FIG. 2, with the reservoir having been dismounted.
Figure 2:
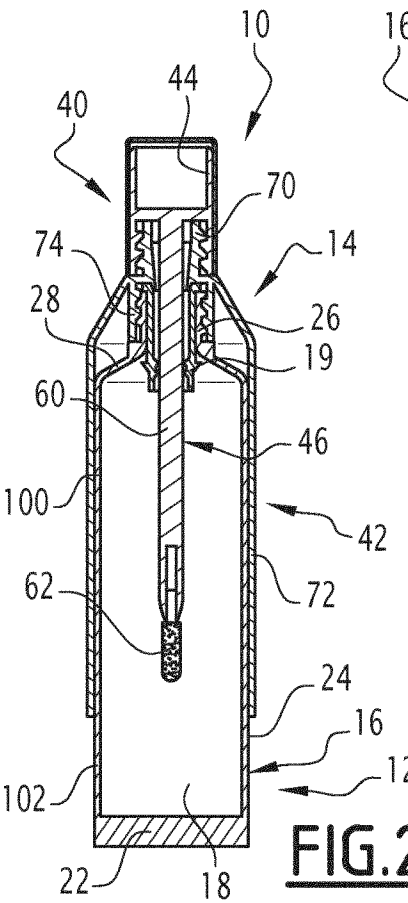
FIG. 2 is a cross-section view similar to FIG. 1, with the reservoir of cosmetic product being mounted in the application device.

A first cosmetic product packaging and dispensing kit 10 is shown in FIGS. 1 to 3.

The kit 10 is intended for the packaging and dispensing of a cosmetic product for makeup, care, and/or coloration. In particular, the cosmetic product is a makeup cosmetic product of keratinous fibers, in particular a mascara.

The kit 10 comprises a cosmetic product reservoir 12, and an application device 14, the reservoir 12 being intended to be mounted in a removable and replaceable manner in the application device 14.

As shown in FIGS. 1 to 3, the reservoir 12 comprises an at least partially deformable hollow wall 16. The hollow wall 16 defines an inner volume 18 receiving the cosmetic product. In this example, the reservoir 12 further comprises a wiper 19 assembled in the hollow wall 16.

Before the mounting thereof in the application device 14, the reservoir 12 advantageously comprises a removable cap 20, intended to close off the inner volume 18 for the packaging of the product.

The hollow wall 16 is for example manufactured from a plastic material such as polyolefin such as PP or PE, a polyamide, a PET, or from laminated complexes The hollow wall 16 comprises a bottom 22, a tubular lateral partition 24 of central axis A-A', and a neck 26 with a transversal extent that is less than the transversal extent of the lateral partition. The tubular partition 24 is advantageously welded at its base, for example by thermowelding in order to form the bottom.

The tubular partition 24 is here of cylindrical outer section. It can be deformed by pinching between the fingers of a user.

The neck 26 protrudes axially with respect to the tubular partition 24. It defines, with the tubular partition 24 a shoulder 28 for closing the inner volume 18.

The neck 26 interiorly defines a sampling passage 30 of cosmetic product that opens into the inner volume 18. It is provided exteriorly with a threading 32 intended for the mounting thereof in the application device 14, as shall be seen hereinafter.

The wiper 19 is immobilized in the neck 26. It comprises at least one transversal wiping member 34, intended to cooperate with an applicator 40 of the application device 14 during the extraction of the applicator 40 outside of the inner volume 18.

The application device 14 comprises the applicator 40, and, according to the invention, an intermediate part 42, intended to receive on one side the applicator 40, and on the other side, the reservoir 12.

The applicator 40 comprises a gripping member 44 and a product application member 46 protruding with respect to the gripping member 44.

In this example, the gripping member 44 comprises a skirt 48, a transverse wall 50 passing through the skirt 48 and an aesthetic cover 52, covering the skirt 48 outside.

The skirt 48 extends about a central axis B-B'. The transverse wall 50 defines in the skirt 48 an outer region 54, and an inner region 56 intended to be mounted on the intermediate part 42.

The outer region 54 is closed off by the aesthetic cover 52. The inner region 56 is provided with at least one retaining element 58 on the intermediate part 42, here formed by a threading.

The product application member 46 protrudes from the gripping member 44. In this example, the product application member 46 protrudes along the central axis B-B', from the transverse wall 50.

It comprises a rod 60 and an applicator element 62 mounted at the free end of the rod 60.

The rod 60 here protrudes along the axis B-B' from the transverse wall 50, through an a beyond the inner region 56.

The applicator element 62 is fixed to the free end of the rod 60. In this example, it is formed by a brush or by a comb.

The length of the product application member 46, protruding beyond the gripping member 44, taken along the axis B-B', is greater than the length of the product application member 46 received in the gripping member 44.

The intermediate part 42 comprises an attachment sleeve 70 for attaching the applicator 40, and a band 72 for protecting the applicator 40, with the sleeve 70 protruding axially to the outside of the band 72.

The intermediate part 42 further comprises an inner fastening member 74 for the removable fastening of the reservoir 12, protruding in the band 72 opposite the attachment sleeve 70.

The attachment sleeve 70 extends about a central axis C-C'. It defines an inner hole 76 for the circulation of the product application member 46. It is provided exteriorly with a complementary retaining element 78 of the gripping member 44, able to cooperate with the retaining element 58 arranged in the inner region 56.

In this example, the complementary retaining element 78 is also formed by a threading.

The band 72 extends about the central axis C-C', which defines a central axis of insertion of the reservoir 12 into the band 72. It has a length $L_F$, taken along the axis C-C', greater than 80% of the length of the product application member 46 extending beyond the gripping member 44. Preferably, the length $L_F$ is greater than or equal to the length of the product application member 46 extending beyond the gripping member 44 and is advantageously between 100% and 120% of this length.

The length $L_F$ is furthermore greater than twice, advantageously greater than 4 times the length $L_0$ of the sleeve for attaching 70, taken along the axis C-C'.

When the applicator 40 is mounted on the attachment sleeve 70, the band 72 extends along the axis C-C' from the reservoir 12 to at least a projection of the free end of the product application member 46 on the axis of insertion C-C'.

The band 72 advantageously exceeds the projection of the free end of the product application member 46 on the axis C-C' at most 10.5 mm.

The band 72 comprises a transverse wall 80 for the support of the attachment sleeve 70, a rigid peripheral wall 82 for protecting the product application member 46, and in this example, a converging intermediate wall 84 connecting the peripheral wall 82 to the transverse wall 82.

The band 72 defines an inner space 85, that opens through the transverse wall 80 by an opening 86 for passing the product application member 46. The inner space 85 opens on the side of the free edge 88 located opposite the attachment sleeve 70, by an insertion opening 90 of the reservoir 12 in the band 72.

The transverse wall 80 carries the attachment sleeve 70, opposite the peripheral wall 82. The passage opening 86 extends in the extension of the inner hole 76, with which it communicates.

The intermediate wall 84 is flared opposite the attachment sleeve 70 from the transverse wall 80.

The peripheral wall 82 has a tubular shape of axis C-C'. In this example, it has a transverse section with an inner contour conjugated with the outer contour of the transverse section of the hollow wall 16.

The peripheral wall 82 has a rigidity greater than that of the hollow wall 16, when it is pressed between the fingers of a user.

The length $L_P$ of the peripheral wall 82 is less than the length $L_C$ of the lateral partition 24 of the hollow wall 16, taken along the axis A-A'.

In this example, the peripheral wall 82 has a transverse section with a constant surface area over its entire length, equal to the area of the insertion opening 88.

The peripheral wall is here a solid wall, devoid of lateral openings.

The inner fastening member 74 extends opposite the attachment sleeve 70 in the inner space 85 of the band 72. It protrudes from the transverse wall 80 along the axis C-C', The inner fastening member 74 comprises a cylindrical skirt 92 and at least an axial locking abutment 94 of the reservoir 12 in the band 72.

The inner fastening member 74 defines a passage 96 for the insertion of the neck 26 of the reservoir 12, communicating with the circulation hole 76 through the passage opening 86, and opening opposite in the inner space 85.

In this example, the length $L_O$ of the inner fastening member 74, taken along the axis C-C' is less than the length $L_F$ of the band 72, in particular is less than 50% of the length $L_F$. Advantageously, the length $L_O$ of the inner fastening member 74 is substantially equal to the length of the intermediate wall 84, taken as a projection along the axis C-C'.

The locking abutment 94 is able to cooperate with a complementary abutment located on the neck 26 of the reservoir 12 in order to immobilize in translation along the axis C-C' the reservoir 12 in the inner space 85 of the band 72. In this example, the locking abutment 94 is formed by an inner threading, protruding towards the axis C-C' in the skirt 92, in order to cooperate with the external threading 32 present on the neck 26.

Advantageously, the intermediate part 42 comprising the attachment sleeve 70, the band 72, and the inner fastening member 74 is formed from one piece. The intermediate part 42 is preferably integral. It is for example carried out by molding a plastic or metal material such as a polyolefin in particular PP or/and PE, a recycled material of the PCR (post consumer recycled) type, a metal, a galvanized part, wood, cork, and/or zamac.

As shall be seen hereinafter, the reservoir 12 is mounted movable with respect to the intermediate part 42 between a dismounted position located separated from the band 72, outside of the inner space 85, and a mounted position in the intermediate part 42.

In the mounted position, the reservoir 12 was partially introduced into the inner space 85 by its neck 26, through the insertion opening 90 and was slid along the axis C-C' to the inner fastening member 74.

The neck 26 is mounted in the inner fastening member 74, the locking abutment 94 cooperating with the complementary abutment present on the neck 26. In this example, this mounting is carried out via screwing the neck 26 in the cylindrical skirt 92 of the inner member 74.

In this position, the reservoir 12 comprises a portion 100 inserted into the band 72 and a portion 102 protruding outside of the band 72 through the insertion opening 90. The portion 102 protruding outside of the band 72 is able to be pinched directly by the user between its fingers in order to reduce the inner volume 18 of the reservoir 12 and concentrate the cosmetic product about the product application member 46.

Moreover, the applicator 40 is movable with respect to the intermediate part 42 between a rest configuration mounted on the part 42 and a configuration for use, arranged separately apart from the part 42.

In the rest configuration, the gripping member 44 is engaged around the attachment sleeve 70. The retaining element 58 cooperates with the complementary element 78 for immobilizing the applicator 40 in translation along the axis C-C' with respect to the intermediate part 42.

The attachment sleeve 70 is inserted in the inner region 56. The rod 60 protrudes through the inner hole 76, the passage opening 86, and the internal space 85.

The applicator element 62 is arranged in the vicinity of the free edge 88.

As such, the applicator 40 is protected against any impacts that it could undergo from the outside by the presence of the band 72, even when the reservoir 12 is not inserted in the band 72.

In the use configuration, the retaining element 58 was disengaged from the complementary element 78, in the present case by unscrewing.

The applicator 40 was extracted through the inner space 85, the intermediate wall 84, and the inner hole 76 in order to be entirely separated from the intermediate part 42. The rod 60 and the application element 62 are passed through the wiper 19 in order to eliminate the cosmetic product in excess present on the applicator element 62.

The operation of the kit 10 shall now be described.

Initially, the kit 10 is for example supplied in the configuration of FIG. 3, with the reservoir 12 occupying its dismounted position, being provided with a cap 20.

The applicator 40 occupies its mounted configuration on the intermediate part 42. The product application member 46 is entirely received in the inner space 85 of the band 72, which protects it against any impacts.

When the user desires to use the kit 10, the user removes the cap 20 from the neck 26. The user then inserts the reservoir 12 into the band 72 through the insertion opening 90 by displacing it in translation along the axis C-C'.

When the neck 26 abuts against the inner fastening member 74, the user engages the locking abutment 94 with the complementary abutment in order to removably fasten the reservoir 12 in the band 72. In this example, the user screws the outer threading 32 present on the neck 26 in the inner threading present in the passage 96 of the inner fastening member 74.

During the insertion of the reservoir 12 into the band 72, the product application member 46, which protrudes through the inner fastening member 74 and through the inner space 85 of the band 72 penetrates into the inner volume 18 of the reservoir 12 through the sampling passage 30.

This being done, the user releases the applicator 40 of the intermediate part 42. In this example, the user grasps the gripping member 44 and unscrews this member away from the attachment sleeve 70.

Then, the user separates the gripping member 44 from the intermediate part 42 and as such extracts the product application member 46 outside of the inner volume 18. The product application member 46 passes through the wiper 19, in order to control the quantity of sampled product. The product application member 46 is then extracted outside of the intermediate part 42 through the passage opening 86 and the inner hole of circulation 76.

The user can then apply the cosmetic product over the body surface desired, in particular on the keratinous fibers using the applicator element 62.

When this application is complete, the user reintroduces the product application member 46 into the attachment sleeve 70, then pushes it into the inner volume 18 of the reservoir 12.

If necessary, before removing the product application member 46 outside of the inner volume 18, the user presses the deformable lateral partition 24 of the reservoir 12 extending beyond the band 72 in order to concentrate the cosmetic product over the product application member 46. The kit 10 according to the invention therefore makes it possible a very effective restitution of the cosmetic product contained in the reservoir 12, by limiting the losses of product.

When the cosmetic product contained in the reservoir 12 is depleted, the user replaces the reservoir 12 with a new reservoir of cosmetic product 12 that advantageously has the same structure as the depleted reservoir 12.

To this effect, the user releases the depleted reservoir 12 from the inner fastening member 74, here by unscrewing it, then extracts the depleted reservoir 12 outside the band 72, through the insertion opening 90.

The user then inserts the new reservoir into the band 72 as described hereinabove. The kit 10 according to the invention makes it possible to use the application device 14 to receive successive reservoirs 12, which limits the quantity of waste produced.

Furthermore, the user can personalize the shape, quantity and nature of the cosmetic product that the user wants to dispense using the application device 14, by replacing if necessary the reservoir 12 inserted into the band 72.

Figures 4, 5, 6, 7, 8:
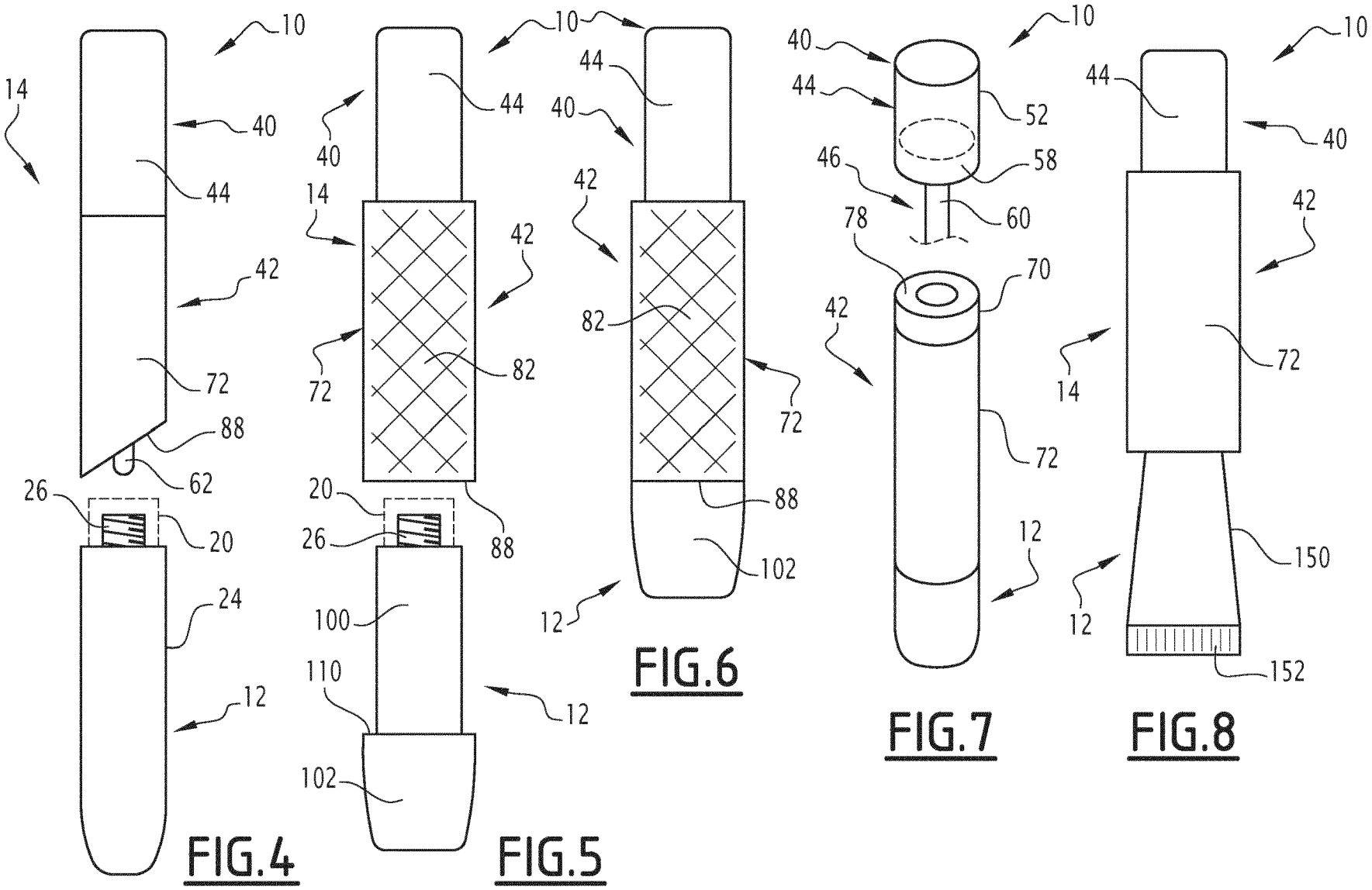
FIG. 4 is a side view similar to FIG. 3 of a second kit according to the invention, with the reservoir being dismounted.
FIG. 5 is a view similar to FIG. 4 of a third kit according to the invention, with the reservoir being dismounted.
FIG. 6 is a view similar to FIG. 5, the reservoir being mounted in the application device.
FIG. 7 is a partial perspective view of a fourth kit according to the invention.
FIG. 8 is a side view of a fifth kit according to the invention.

In the alternative shown in FIG. 4, the band 72 has a free edge 88 arranged in a plane inclined with respect to the axis C-C' of insertion of the reservoir 12 in the band 72. This guarantees better visibility on the free end of the product application member 46 during the setting in place of the reservoir 12 in the band 72, while still protecting the product application member 46.

In an alternative shown in FIGS. 5 and 6, the hollow wall 16 of the reservoir defines an annular shoulder 110 between the portion 100 intended to be inserted into the band 72 and the portion 102 protruding outside of the band 72.

The shoulder 110 abuts against the free edge 90 of the band 72 when the reservoir 12 occupies its mounted position. Advantageously, an outer surface of the band 72 is flush with an outer surface of the portion 102 on the free edge 90. This improves the aesthetic aspect of the kit 10.

In another alternative, of which an example is diagrammatically shown in FIGS. 5 and 6, the peripheral wall 82 of the band 72 is perforated. It delimits a plurality of through-openings advantageously defining geometrical patterns. This also improves the aesthetic aspect of the kit 10.

In the alternative shown in FIG. 7, the attachment sleeve 70 are devoid of threading. Likewise, the gripping member 44 is devoid of complementary threading.

The retaining element 58 on the gripping member 44 is formed by a magnet or by a ferromagnetic part able to be magnetized.

The complementary retaining element 78 of the attachment sleeve 70 also comprises a magnet or a ferromagnetic part able to be magnetized, that magnetically cooperates with the retaining element 58. This offers an effective fastening of the gripping member 44 on the sleeve of attachment 70, while still offering a very pleasant aesthetic aspect.

In the alternative shown in FIG. 8, the reservoir 12 is formed by a flexible tube 150 closed by pinching and/or welding at its free edge 152. This simplifies the manufacturing and the filling of the reservoir 12, reducing the cost thereof.

In an alternative (not shown), the wiper 19 is mounted integral with the intermediate part 42, in the passage 96.

In another alternative (not shown), the locking abutment 94 of the inner fastening member is a snap-fitting projection or a snap-fitting housing of the neck 26 of the reservoir 12.

In a variant (not shown), the product application member 46 comprises a rod 60 which is made in two parts. A first part of the rod 60 is permanently attached to the gripping member 44. A second part of the rod 60, holding the applicator element 62 is removable from the first part. The second part of the rod 60 is for example threaded or clipped in the first part, so as to be removable by a user.

For an example of a two-part rod 60 that can be disconnected, one may refer to document EP0995368.

The second part of the rod 60 and the applicator element 62 can therefore be disposed of after being used. A new second part of the rod 60 having a clean applicator element 62 can be then mounted on the first part of the rod 60.

The kit 10 according to the invention therefore comprises a first set of parts comprising the gripping member 44 of the applicator 40, the first part of the rod 60 and the intermediate part 42. This first set of parts is intended to be kept by the user and to be reused several times.

A second set of parts of the kit 10 is interchangeable, and is intended to be disposed of after being used by the user. This second set of parts comprises the reservoir 12, as well as the second part of the rod 60 of the applicator, and the applicator element 62.

Advantageously, in the second set of parts, the second part of the rod 60 is mounted in the reservoir 12 and is connected to the reservoir 12 through a frangible member such as a frangible lug.

The first part of the rod 60 protrudes out of the gripping member 44. It is introduced in the reservoir 12 at the first use to connect with the second part of the rod 60 and to break the frangible member.

Thus, a new applicator element 62 is provided each time the reservoir 12 is changed, which limits the risk of microbiological contamination.

The invention claimed is:

1. A kit for cosmetic product packaging and application comprising a cosmetic product application device, comprising:

an applicator, comprising a gripping member and a product application member removably housed in a reservoir of a cosmetic product;

an intermediate part comprising an attachment sleeve for the removable fastening of the gripping member, the attachment sleeve defining a circulation hole of the product application member;

wherein the intermediate part comprises an outer band for protecting the applicator protruding opposite the attachment sleeve, the outer band having at its free edge an insertion opening of the reservoir, and wherein the outer band defines an inner space designed to receive at least a part of the reservoir, wherein the reservoir comprises an internal portion inserted into the outer band and a portion protruding outside of the outer band, with an outer surface of the outer band being flush with an outer surface of the portion protruding outside of the outer band;

the intermediate part comprises an inner fastening member for the removable fastening of the reservoir, protruding in the outer band opposite the attachment sleeve, the inner fastening member-comprising at least one axial locking abutment of the reservoir in the outer band and wherein the inner fastening member extends in the inner space, wherein when the applicator is mounted on the attachment sleeve, the outer band extends opposite the attachment sleeve along an axis of insertion (C-C') of the reservoir in the outer band, at least to the extent to which the free end of the product application member on the axis of insertion (C-C') extends when mounted onto the attachment sleeve; and wherein the reservoir of cosmetic product is removably mounted on the inner fastening member in the outer band; and wherein the kit comprises an auxiliary cosmetic product reservoir able to be mounted on the inner fastening member in the outer band in place of the reservoir.

2. The kit according to claim 1, wherein the inner fastening member comprises a peripheral skirt, the locking abutment radially protruding from the peripheral skirt.

3. The kit according to claim 2, wherein the inner fastening member comprises a threading or a snap-locking member, the locking abutment being the threading or the snap-locking member.

4. The kit according to claim 1, wherein, when the applicator mounted on the attachment sleeve, the outer band exceeds the projection of the free end of the product application member on the axis of insertion (C-C') at most 10.5 mm, the reservoir mounted on the inner fastening member being protruding outside of the outer band through the insertion opening.

5. The kit according to claim 1, wherein the attachment sleeve has a threading, the gripping member having a complementary threading complementary with the attachment sleeve able to engage on the threading of the attachment sleeve.

6. The kit according to claim 1, wherein the outer band is at least partially perforated.

7. The kit according to claim 1, wherein the product application member comprises a rod and an applicator element mounted at the free end of the rod, the rod comprising a first part permanently connected to the gripping member and a second part, removably attached to the first part, the second part holding the applicator element.

8. The kit according to claim 1, wherein the reservoir protrudes outside of the outer band through the insertion opening.

9. The kit according to claim 1, wherein the reservoir comprises a wall with a stretchability greater than the stretchability of the outer band.

10. The kit according to claim 1, comprising a wiping member mounted on the reservoir and/or on the inner fastening member.

11. The kit according to claim 1, wherein the reservoir comprises a neck able to cooperate with the inner fastening member, the neck comprising a complementary locking abutment or a complementary locking housing cooperating with the axial locking abutment of the reservoir in the outer band.

12. The kit according to claim 1, wherein the product application member comprises a rod and an applicator element mounted at the free end of the rod, the rod comprising a first part permanently connected to the gripping member and a second part, removably attached to the first part, the second part holding the applicator element, the kit comprising a first set of parts comprising the gripping member of the applicator, the first part of the rod, and the intermediate part, and a second set of parts comprising the reservoir and the second part of the rod along with the applicator element, the second set of parts being interchangeable.

13. The kit according to claim 1, wherein the inner fastening member comprises a peripheral skirt, the locking abutment radially protruding from the peripheral skirt.

14. The kit according to claim 1, wherein the reservoir mounted on the inner fastening member is intended to protrude outside of the outer band through the insertion opening.

15. The kit according to claim 1, wherein the outer band extends at least to the extent to which the free end of the product application member on the axis of insertion extends when the reservoir is mounted on the inner fastening member in the outer band and when the reservoir is away from the inner fastening member outside the outer band.

16. The kit according to claim 2, wherein the peripheral skirt is distinct from the outer band.

17. A kit for cosmetic product packaging and application comprising a cosmetic product application device, comprising:

an applicator, comprising a gripping member and a product application member removably housed in a reservoir of a cosmetic product;

an intermediate part comprising an attachment sleeve for the removable fastening of the gripping member, the attachment sleeve defining a circulation hole of the product application member;

wherein the intermediate part comprises an outer band for protecting the applicator protruding opposite the attachment sleeve, the outer band having at its free edge an insertion opening of the reservoir, and wherein the outer band defines an inner space designed to receive at least a part of the reservoir, the intermediate part comprises an inner fastening member for the removable fastening of the reservoir, protruding in the outer band opposite the attachment sleeve, the inner fastening member-comprising at least one axial locking abutment of the reservoir in the outer band and wherein the inner fastening member extends in the inner space, wherein the reservoir comprises an internal portion inserted into the outer band and a portion protruding outside of the outer band, with an outer surface of the outer band being flush with an outer surface of the portion protruding outside of the outer band and wherein the reservoir comprises a neck able to cooperate with the inner fastening member, the neck comprising a complementary locking abutment or complementary locking housing cooperating with the axial locking abutment of the reservoir in the outer band;

wherein when the applicator is mounted on the attachment sleeve, the outer band extends opposite the attachment sleeve along an axis of insertion (C-C') of the reservoir in the outer band, at least to the extent to which the free end of the product application member on the axis of insertion (C-C') extends when mounted onto the attachment sleeve; and wherein the reservoir of cosmetic product is removably mounted on the inner fastening member in the outer band.

* * * * *